US008820739B1

(12) United States Patent
Linder et al.

(10) Patent No.: US 8,820,739 B1
(45) Date of Patent: Sep. 2, 2014

(54) METHOD FOR OPTIMIZING FEEDER MODULE FEEDER TRAY CAPACITY

(71) Applicant: Xerox Corporation, Norwalk, CT (US)

(72) Inventors: Michael J Linder, Walworth, NY (US); Benjamin Paulson, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/856,462

(22) Filed: Apr. 4, 2013

(51) Int. Cl.
*B65H 5/00* (2006.01)
*B65H 7/02* (2006.01)

(52) U.S. Cl.
CPC ..... *B65H 5/00* (2013.01)
USPC ..... 271/258.01; 271/258.04; 271/3.14

(58) Field of Classification Search
USPC ..... 271/3.14, 3.15, 9.03, 258.01, 258.02, 271/258.04
See application file for complete search history.

(56) References Cited

U.S. PATENT DOCUMENTS

| | | | | |
|---|---|---|---|---|
| 5,853,171 | A * | 12/1998 | Halpenny | 271/126 |
| 5,984,299 | A * | 11/1999 | Hirota et al. | 271/161 |
| 6,308,951 | B1 * | 10/2001 | Allmendinger et al. | 271/265.04 |
| 7,177,554 | B2 * | 2/2007 | Van Vliembergen | 399/23 |
| 7,900,906 | B2 * | 3/2011 | Roberts et al. | 271/3.14 |
| 2003/0015836 | A1 * | 1/2003 | Westcott et al. | 271/152 |
| 2004/0061280 | A1 * | 4/2004 | Sciurba et al. | 271/152 |
| 2007/0096387 | A1 * | 5/2007 | Sciurba et al. | 271/152 |
| 2009/0166950 | A1 * | 7/2009 | Sciurba et al. | 271/9.03 |
| 2009/0261524 | A1 * | 10/2009 | Nakayama et al. | 271/3.14 |
| 2010/0327514 | A1 * | 12/2010 | Sciurba et al. | 271/152 |
| 2012/0286465 | A1 * | 11/2012 | Ooba | 271/9.01 |

* cited by examiner

*Primary Examiner* — Patrick Cicchino

(57) ABSTRACT

A method and apparatus that adjusts the step count at which a tray low paper condition is declared based on the number of outstanding feed commitments and the average number of feeds between tray increments. After a first tray increment has occurred, feeder software will wait a pre-determined number of additional tray increments, and will then calculate the average number of feeds between increments. Using this average and the number of outstanding feed commitments a low paper condition is declared when a predetermined logical test is true.

14 Claims, 1 Drawing Sheet

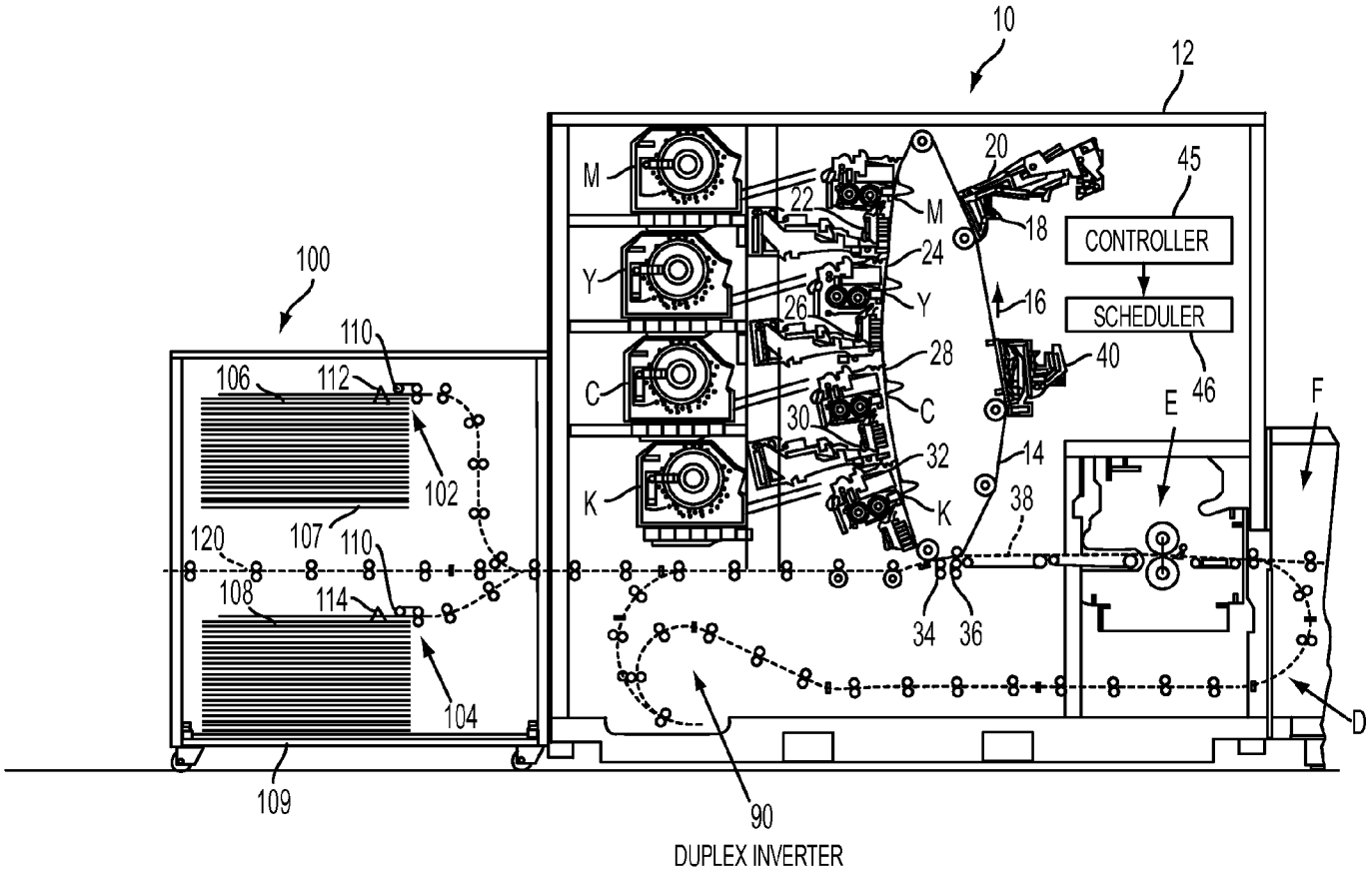
CONTROLLER
SCHEDULER
DUPLEX INVERTER
10
12
14
16
18
20
22
24
26
28
30
32
34
36
38
40
45
46
90
100
102
104
106
107
108
109
110
112
114
120
D
E
F
M
Y
C
K

METHOD FOR OPTIMIZING FEEDER MODULE FEEDER TRAY CAPACITY

BACKGROUND

1. Field of the Disclosure

This disclosure relates to an apparatus and method that optimizes feedable sheet availability in a feed tray of a feeder module.

2. Description of Related Art

As shown in FIG. 1 of U.S. Pat. No. 7,900,906 B2, the contents of which are included herein by reference, feeding of media sheets in present day copiers and printers include a scheduler and media sheet source, as well as, a marking engine and media sheet stacker. In a marking engine, such as a xerographic marking engine, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within a document. Subsequently, the electrostatic latent image on the photoconductive insulating surface is made visible by developing the image with a developing material. Generally, the developing material comprises toner particles adhering triboelectrically to carrier granules. The developed image is subsequently transferred to a sheet of media, such as a sheet of paper, a transparency, or other sheet of media, that is fed from a media sheet source. A stacker can then stack the marked media sheets. A scheduler can schedule feed commitments for a number of sheets to be fed by the media source, marked by the marking engine, and stacked by the stacker. For example, the scheduler can inform each element that a certain number of sheets will be processed by the elements. As one of the scheduled elements, a media sheet source must plan and commit to a variable number of feed commitments.

Unfortunately, feedable capacity of the media sheet source may not be sufficient to satisfy outstanding feed commitments scheduled by the scheduler. For example, the media sheet source fed tray may not contain enough media sheets to meet the outstanding feed commitments. An unscheduled shutdown or jam can result from the media sheet source attempting to feed sheets after the feed tray is empty. Attempting to feed sheets after the feed tray is empty can also result in damage to the media sheet source. Furthermore, other elements, such as, the marking engine and the stacker can be damaged if they attempt to process scheduled, but unfed sheets. This can occur when a media sheet source cannot adequately control its feed commitments based on it feedable capacity and will stop feeding sheets even though the feed tray is not empty.

Additionally, due to the scheduling mechanism applied in a current machine, it is possible for the print engine to schedule as many as 50 sheets ahead. In order to compensate for this without declaring a fault, the feeder tray must declare low paper early enough to compensate for these outstanding commitments. Currently, as disclosed in heretofore mentioned U.S. Pat. No. 7,900,906 B2, this is done based on an assumption of average sheet thickness and number of outstanding commitments. When this approach results in an early declaration of low paper, more paper is left in the feeder tray. When the low paper declaration occurs too late, the feeder tray can reach its upper travel limit, and misfeeds can occur.

Thus, there is still a need for a method and apparatus that can reliably control feed commitments.

BRIEF SUMMARY OF THE DISCLOSURE

Accordingly, in answer to the above-mentioned problems, disclosed herein is a method and apparatus that adjusts the step count at which a tray low paper condition is declared based on the number of outstanding feed commitments and the average number of feeds between tray increments (or lifts) in order to prevent a premature tray low paper condition. After a first tray increment has occurred, feeder software waits a pre-determined number of additional tray increments, and will then calculate the average number of feeds between increments. Using this average and the number of outstanding feed commitments the low paper condition is declared when a predetermined logical test is true.

The disclosed reprographic system that incorporates the disclosed improved system for stream feeding sheets for multiple jobs from a feed tray may be operated by and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

FIG. 1 is a partial, frontal view of an exemplary modular xerographic printer that includes a scheduler in order to reliably control feed commitments based on the media being fed.

DETAILED DESCRIPTION OF THE PREFERRED EMBODIMENT

While the present disclosure will hereinafter be described in connection with a preferred embodiment, it will be understood that it is not intended to limit the disclosure to that embodiment. On the contrary, it is intended to cover all alternatives, modifications and equivalents as may be included within the spirit and scope of the invention as defined by the appended claims.

As in other xerographic machines, and as is well known, printer 10 in FIG. 1 shows an electrographic printing system including the apparatus and method that optimizes feedable sheet availability in a feed tray of a feeder module embodiment of the present disclosure. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Marking module 12 includes a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 brings the copy sheets into contact with the image on belt 14. Sheet feeder module 100 includes high capacity feeders 102 and 104 with each including a feed head 110 which feed sheets from sheet stacks 106 and 108 positioned on media supply trays 107 and 109 into imaging or marking module 12. Additional high capacity media trays could be added to feed sheets along sheet path 120, if desired.

Conventional air fluffers 112 and 114 are added to high capacity feeders 102 and 104 in order to aid in separating the top sheet in stacks 106 and 108 from the remaining sheets and are turned ON after the stack height of each tray has been raised to a predetermined or highest position.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1, and in accordance with the present disclosure, scheduler 46 facilitates printer 10 scheduling ahead multiple jobs that include as many as 50 sheets, therefore, it is critical to make sure that sufficient media or copy sheets are present within a selected tray of feed trays 107 and 109 of feeder module 100 to accommodate the multiple jobs. Periodically, the selected media supply tray from which sheets are being fed is incrementally indexed or stepped upwardly based upon a step count which could be, for example, the actual steps a stepper motor rotates or a unit of measurement, such as, 1 mm/step, etc, in order to maintain a proper sheet feeding position of the sheet stack. In order to compensate for the scheduling of multiple jobs that include as many as 50 sheets without declaring a fault, through controller 45 and scheduler 46, the step count at which the tray low paper condition is declared is adjusted based on the number of outstanding feed commitments and the average number of feeds between tray increments (or lifts) of the tray. After the first tray increment has occurred, the scheduler will wait a pre-determined number of additional tray increments, and will then calculate the average number of feeds between increments. Using this average and the number of outstanding feed commitments a low paper condition is declared when the following logic test is true:

$$\text{Current Step Count} > \left(\text{Low Paper Step Count} - \left(\frac{\text{Number of } \textit{OutstandingCommitments}}{\text{Number of sheets per increment}}\right) * \text{Steps per increment}\right)$$

That is, a low paper condition is declared if the current step count is greater than the low paper step count minus the number of outstanding commitments divided by the number of sheets per increment times the steps per increment.

Air nozzles or fluffers 112 and 114 of high capacity feeders 102 and 104, respectively, are turned ON after the maximum stack height is initially reached and it is important to wait until the first increment has occurred before calculating the sheets per index. Using this method, the "Low Paper Step Count" can be set to the topmost tray position that can be reliably reached without hardware damage. Declaration of the low paper condition will now automatically adjust for the media being fed and will be updated real-time based on the outstanding feed commitments.

In recapitulation, a scheduling method and apparatus is disclosed that facilitates the scheduling of as many as 50 sheets ahead for multiple jobs without declaring a break in feeding and comprises adjusting the step count at which a tray lower paper condition is declared based on the number of outstanding feed commitments and the average number of feeds between tray increments. After the first tray increment has occurred, a wait of a pre-determined number of additional tray increments is accomplished, and then the average number of feeds between increments is calculated. Using this average and the number of outstanding feed commitments the low paper condition is declared. A benefit of this improved scheduling method and apparatus include the ability to automatically adjust the feeder low paper condition according to the media being fed, which has added as much as 25 mm of additional feedable capacity to the feed trays.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for optimizing feed tray capacity of a printer, comprising:

providing a feeder module that includes at least one feed tray that is incrementally indexed based upon a step count;

providing a scheduler module for scheduling the feeding of media from said at least one feed tray for multiple separate jobs requiring a plurality of media for each of said multiple separate jobs;

declaring a tray low media condition of said at least one feed tray when required; and preventing a premature declaring of said tray low media condition by utilizing the number of outstanding feed commitments and the average number of feeds between tray increments.

2. The method of claim 1, including providing a controller connected to said scheduler.

3. The method of claim 1, wherein said scheduler after an initial tray increment has occurred, waits a predetermined number of additional tray increments, and then calculates the average number of feeds between increments.

4. The method of claim 3, including using said average number of feeds between increments and said number of outstanding feed commitments to declare said low media condition if the current step count is greater than the low media step count minus the number of outstanding commitments divided by the number of sheets of media per increment times the steps per increment.

5. The method of claim 4, including said declaration of said low media condition being automatically adjusted for the specific media being fed.

6. The method of claim 5, including adjusting said low media condition in real-time based upon said outstanding feed commitments.

7. The method of claim 1, including providing said step count as a measurement in millimeters.

8. A method for optimizing the scheduling of multiple jobs with each job requiring the feeding of multiple sheets of paper from a paper tray before declaring a fault in a xerographic apparatus, comprising:

providing a paper tray, said paper tray being adapted to index paper therein a predetermined amount based upon steps counts;

waiting a predetermined number of indexes after a first index of said paper tray has occurred and then calculating the average number of feeds between indexes;

using said average number of feeds between indexes and the number of outstanding feed commitments to declare a tray low paper condition;

providing a scheduler for controlling said indexing of said paper tray; and declaring a tray low paper condition when the following logic test is true:

$$\text{Current Step Count} > \left(\text{Low Paper Step Count} - \left(\frac{\text{Number of } \textit{OutstandingCommitments}}{\text{Number of sheets per increment}}\right) * \text{Steps per increment}\right)$$

9. The method of claim 8, wherein said declaration of tray low paper condition is automatically adjusted for the paper being fed.

10. The method of claim 9, wherein said declaration of tray low paper condition is updated in real-time based upon said outstanding feed commitments.

11. A printing apparatus, comprising:

at least one feed tray containing feedable media sheets;

a feeder module coupled to said at least one feed tray of feedable media sheets, said feeder module being adapted to control feeding of said feedable media sheets from said at least one feed tray;

a marking engine coupled to said at least one feed tray of feedable media sheets, said marking engine marks images on said media sheets fed by said at least one feed tray;

a marker module coupled to said marking engine, said marker module controls said marking engine; and a scheduler coupled to said feeder module and said marker module to schedule feed commitments for said feeder module, mark commitments for said marker module and to index said at least one feed tray of feedable media sheets a predetermined amount based upon step counts, said scheduler being configured to wait a predetermined number of indexes after a first index of said feed tray has occurred and then calculate the average number of feeds between indexes, and wherein said scheduler is adapted to declare a tray low media condition with said average number of feeds between indexes and the number of outstanding feed commitments being used to declare said tray low media condition if the current step count is greater than the low media step count minus the number of outstanding commitments divided by the number of sheets of media per index times the steps per index.

12. The printing apparatus of claim 11, wherein said declaration of tray low media condition automatically adjusts for the media being fed.

13. The printing apparatus of claim 12, wherein said declaration of tray low media condition is updated in real-time based upon said outstanding feed commitments.

14. The printing apparatus of claim 13, wherein said feeder module includes at least one air fluffer that is turned ON after said at least one feed tray of feedable media sheets has reached an initial stack height position.

* * * * *